US006935908B2

(12) United States Patent
Garcia

(10) Patent No.: US 6,935,908 B2
(45) Date of Patent: Aug. 30, 2005

(54) WEED DEFLECTOR FOR AN OUTBOARD MOTOR WATER INTAKE

(76) Inventor: Ediverto Garcia, 1701 Hester St., Donna, TX (US) 78537

( * ) Notice: Subject to any disclaimer, the term of this patent is extended or adjusted under 35 U.S.C. 154(b) by 0 days.

(21) Appl. No.: 10/746,306

(22) Filed: Dec. 24, 2003

(65) Prior Publication Data

US 2005/0142958 A1 Jun. 30, 2005

(51) Int. Cl.[7] ..... B63H 5/16
(52) U.S. Cl. ..... 440/71
(58) Field of Search ..... 440/71; 416/247 A

(56) References Cited

U.S. PATENT DOCUMENTS

| | | | | |
|---|---|---|---|---|
| 2,355,842 A | | 8/1944 | Arado | |
| 2,597,551 A | * | 5/1952 | Van Nort | 416/247 R |
| 3,027,864 A | | 4/1962 | Polson | |
| 3,147,733 A | | 9/1964 | Engel | |
| 3,446,177 A | | 5/1969 | Thornburg et al. | |
| 4,013,033 A | | 3/1977 | Porter et al. | |
| 4,070,984 A | | 1/1978 | Kappas | |
| 4,078,516 A | | 3/1978 | Balius | |
| 4,565,533 A | * | 1/1986 | Springer | 440/71 |
| 4,832,634 A | | 5/1989 | Kearns | |
| 5,178,565 A | | 1/1993 | Jacobson | |
| 5,344,346 A | | 9/1994 | Griffin | |
| 5,468,165 A | | 11/1995 | Weber et al. | |
| 5,577,941 A | | 11/1996 | Charter | |
| 5,664,977 A | | 9/1997 | Dinkowitz et al. | |
| 5,928,042 A | | 7/1999 | Quiggins | |
| 6,168,483 B1 | | 1/2001 | McIntosh | |
| 6,179,673 B1 | | 1/2001 | Leroux | |
| 6,416,371 B1 | | 7/2002 | Johnson | |
| 2001/0041483 A1 | * | 11/2001 | Lammli | 440/71 |

* cited by examiner

*Primary Examiner*—Stephen Avila
(74) *Attorney, Agent, or Firm*—Royston Rayzor Vickery & Willams L.L.P.; William P. Glenn, Jr.

(57) ABSTRACT

A weed deflector for a water intake formed in the lower unit of an outboard motor or stern drive of an inboard outboard engine. The weed deflector includes a fin with a leading edge disposed between a fin base and a tip. A mounting plate fixes the fin base to the lower unit (or stern drive) up flow of the water intake in either a horizontal or vertical orientation. The cross sectional form of the fin induces turbulence in the water flow adjacent to the water intake thereby reducing the ability of debris from obstructing the water intake.

11 Claims, 3 Drawing Sheets

WEED DEFLECTOR FOR AN OUTBOARD MOTOR WATER INTAKE

TECHNICAL FIELD

The present invention relates generally to outboard motors. More specifically the present invention relates to weed deflectors that eliminate or at least reduce the amount of weeds and debris that can obstruct an outboard motor's water intake(s).

BACKGROUND ART

There exist a number of guards for outboard motors and the lower units of inboard/outboard engines that disclose a variety of means to keep its spinning propeller(s) from coming in contact with objects in the water (like swimmers or debris), and even sub-aquatic features (like rocks and shoals). Typically a wire basket arrangement fixed to the lower portion of the motor enshrouds the propeller. A good example of such a guard is disclosed in U.S. Pat. No. 5,928,042 attributed to Quiggins entitled Propeller Guard (hereinafter Quiggins '042). Additional examples are U.S. Pat. No. 5,44,346 attributed to Griffin entitled Driveshaft Housing Attachment (hereinafter Griffin '346); U.S. Pat. No. 4,832,634 attributed to Kearns entitled Flow Control Device and Protector Device For An Outboard Motor (hereinafter Kearns '634); U.S. Pat. No. 4,078,516 attributed to Balius entitled Propeller Guard (hereinafter Balius '516); U.S. Pat. No. 4,070,984 attributed to Kappas entitled Outboard Motor and Weed Guard Therefore (hereinafter Kappas '984); and U.S. Pat. No. 4,013,033 attributed to Porter et al entitled Weed Guard for Trolling Motors (hereinafter Porter '033).

Other propeller guards incorporate a cutter to cleave debris into smaller portions that are in turn deflected away from the spinning propeller by a plurality of fingers. A good example of such a guard is disclosed in U.S. Pat. No. 2,355,842 attributed to Arado entitled Combined Cutter, Distributor and protector for Outboard Motors (hereinafter Arado '842).

Protecting the propeller is also achieved by fitting a striker up flow of the outboard motor's lower unit. When debris or a submerged obstruction comes in contact with the striker, the lower unit is temporarily pivoted up thereby removing the spinning propeller from the debris or obstruction. Such examples are disclosed in U.S. Pat. No. 6,179,673 attributed to Leroux entitled Outboard Motor Protection Apparatus (hereinafter Leroux '673) and U.S. Pat. No. 5,664,977 attributed to Dinkowitz et al entitled Boat Propeller Sled (hereinafter Dinkowitz '977); and U.S. Pat. No. 5,178,565 attributed to Jacobson entitled Lower Unit Guard (hereinafter Jacobson '565). All of the propeller guards disclosed above do not provide any protection for the motor's water intake(s) from debris.

The typical water intake for an outboard motor is fitted with a screen, strainer or grate to keep waterborne debris from being ingested by the motor's water pump. However, debris can become clogged or lodged in such a screen or strainer, which in turn reduces the flow of cooling water to the motor. Reducing the flow of cooling water can reduce the work life of or at least increase the wear and tear on the motor.

Aside from screens and strainers, a variety of rods or fins positioned over or in the water inlet have been used to prevent clogging of the strainer (if fitted) or the inlet itself. The rods or fins are positioned over (or in the inlet) in such a manner to deflect debris away from an inlet as water flows around the rods or fins. Examples of such arrangement are disclosed in U.S. Pat. No. 3,147,733 attributed to Engel for an Inlet Screen (hereinafter Engel '733); U.S. Pat. No. 3,446,177 attributed to Thornburg et al for a Water Jet Propulsion Apparatus (hereinafter Thornburg '177); U.S. Pat. No. 5,468,165 attributed to Weber et al for Grass and Debris Exclusion Plate for Marine Jet Pumps (hereinafter Weber '165); and U.S. Pat. No. 5,577,941 attributed to Chartier for Marine Jet Drive Weed Grate (hereinafter Chartier '941). Each of these devices obstructs the intake not unlike the debris it attempts to clear. Such obstructing debris deflectors require a larger inlet opening for new construction. Such obstructing debris deflectors fitted on existing water inlets restrict water flow causing reduced cooling and increased motor wear. Furthermore, such obstructing deflectors require a custom fit into or over the inlet in order to work properly.

In view of the above described deficiencies and issues associated with existing deflectors, the present invention has been developed to alleviate these drawbacks and provide further benefits to the user. These enhancements and benefits are described in greater detail herein below with respect to several alternative embodiments of the present invention.

SUMMARY OF INVENTION

The present invention in its several disclosed embodiments alleviates the drawbacks and deficiencies described above with respect to conventional water intake debris deflectors. The present invention incorporates several additionally beneficial features.

The improved water intake debris deflector includes a fin positioned up flow to a water intake located in the lower unit of an outboard motor (or inboard outboard stern drive). The leading edge of the fin is angled in such a manner as to push debris down and away from a water inlet. Furthermore, the fin's length and thickness causes small amounts of turbulence in the water flow adjacent to a water intake and propeller. Disrupting the laminar flow of the water adjacent to the water intake reduces the ability of debris to become trapped over the water inlet. Furthermore, disrupting the laminar flow of the water adjacent to a propeller decreases the likelihood of propeller cavitation.

The improved debris deflector may further include a limiting bracket that prevents excessive fin waiver. Excessive fin waiver can cause the misdirection of water away from an inlet, cavitation bubbles (in extreme cases) or even fin failure.

It is the general object of the present weed deflecting invention to provide a low maintenance passive weed deflector for water inlets formed in lower units of outboard motors or inboard outboard stern drives.

It is another object of the present invention to provide a weed-deflecting device capable of being easily fitted to existing lower units of outboard motors or inboard outboard stern drives.

It is a further object of the present invention to provide a weed-deflecting device capable of disrupting the laminar flow of water in the region of a water intake to reduce debris obstruction.

It is still another object of the present invention to provide a weed-deflecting device capable of disrupting the laminar flow of water in the region of a propeller to reduce cavitation.

It is yet another object of the present invention to provide a weed deflecting device which does not obstruct or occlude a water intake opening formed in the lower unit of an outboard motor or inboard outboard stern drive.

BRIEF DESCRIPTIONS OF THE DRAWINGS

The invention is described in greater detail in the following examples and with reference to the attached drawings, in which.

DETAILED DESCRIPTION OF THE INVENTION

General Overview

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and function details disclosed herein are not be interpreted as limiting, but merely as a basis for the claims and as a representative basis for teaching one skilled in the art to variously employ in the present invention.

Figure 1:
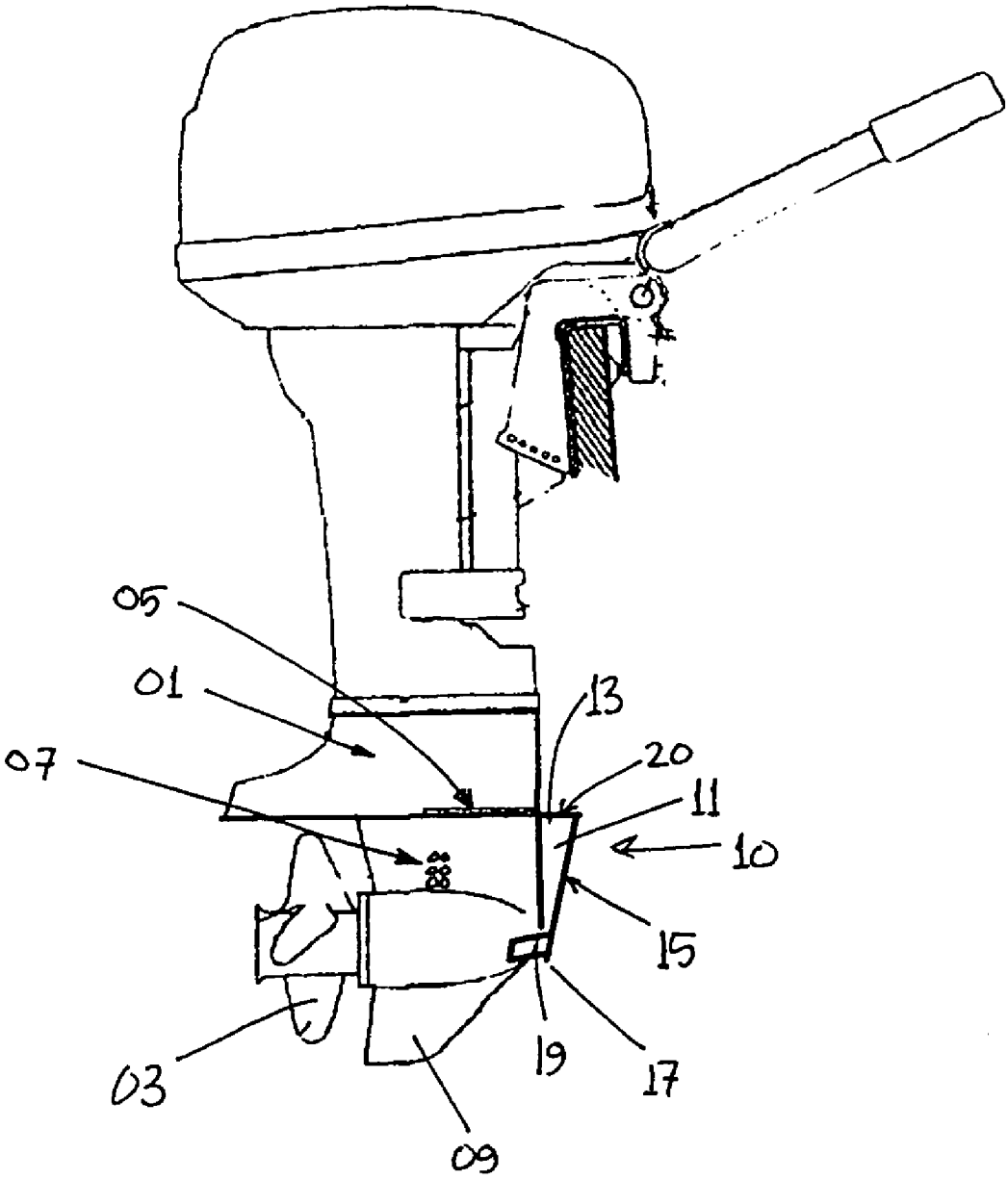
FIG. 1 is an elevation view of an improved weed deflector fixed vertically to an outboard motor's lower unit.

The present invention is directed toward a weed deflector 10 that includes at least one fin 11 with a leading edge 15 disposed between a fin base 13 and a tip 17. A mounting plate 20 is configured to fix fin base 13 to a lower unit 01 of an outboard motor (or stern drive of an inboard outboard engine 01) (See FIGS. 1 and 3). In a preferred embodiment, fin 11 is fixed in a vertical orientation to a cavitation plate 05 by a mounting plate 20 (See FIG. 1). In another preferred embodiment, a fin 11 is fixed horizontally to a stern drive 01 by a mounting plate 20 (See FIG. 3). In either orientation, at least a portion of leading edge 15 extends across a portion of the water flow that moves adjacent to at least a portion of water inlet 07 (See FIGS. 1 and 3).

Figure 2:
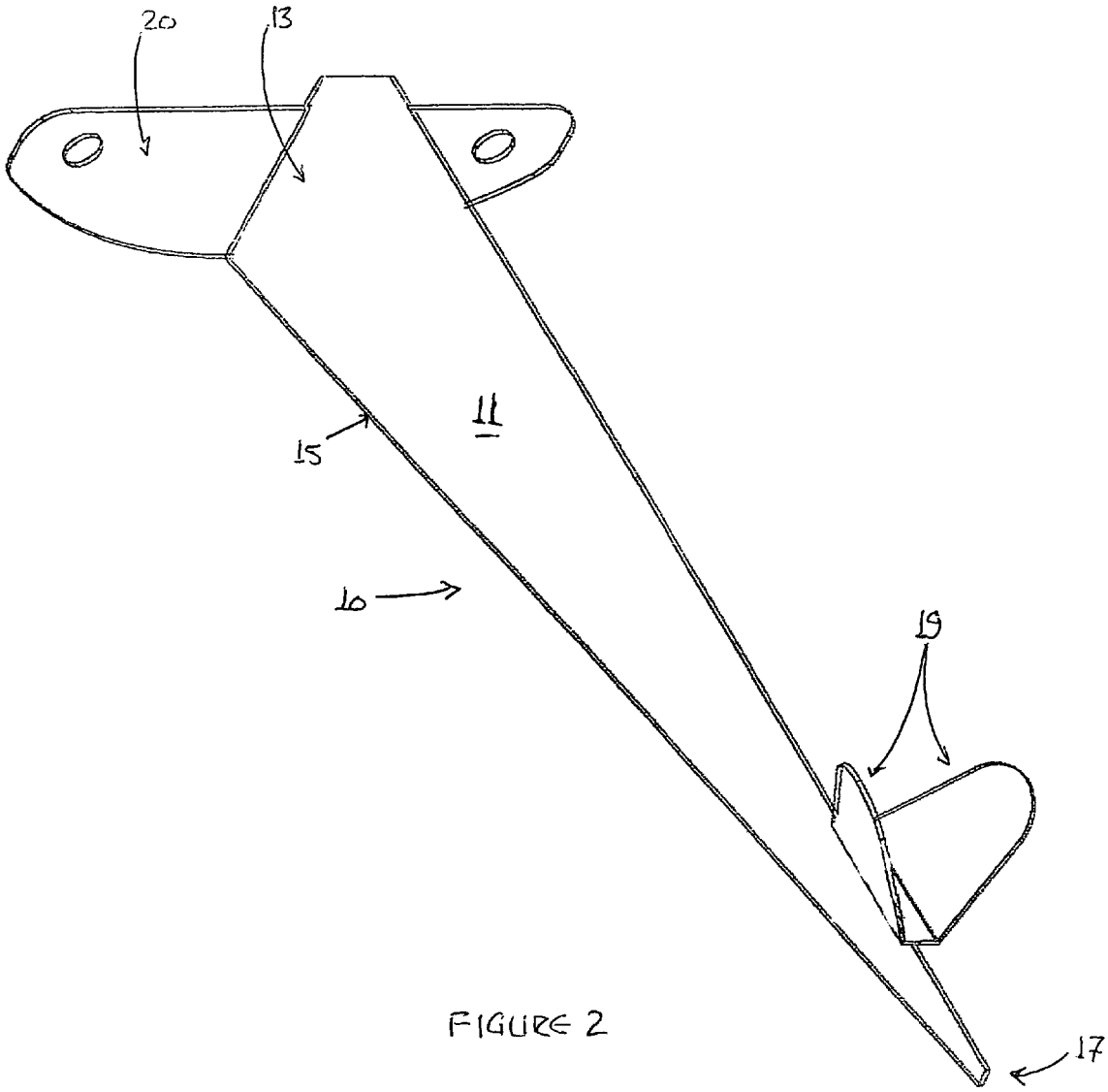
FIG. 2 is a perspective view of an improved weed deflector fixed vertically to an outboard motor's lower unit.

In a preferred embodiment, the width of fin 11 tapers from base 13 to tip 17. Such tapering provides the necessary cant or sweep to the leading edge 15 to direct debris away from water inlet 07 and towards tip 17. It is contemplated that the width of fin base 13 may extend beyond mounting base plate 15 (See FIG. 2). In an alternative embodiment, the width of fin base 13 is equal to or less than the width of mounting base plate 15 (not shown). Tip 17 can be terminated at any distance from base 13. With a fin 11 in a vertical orientation, the preferred location of tip 17 is just above skeg 09 (See FIG. 1). With a fin 11 in a horizontal orientation, the preferred location of tip 17 is no further than the tips of the propeller 03 (not shown). Such a preferred configurations allows debris to be push away from propeller 03. Tip 17 can be pointed, curved or truncated.

In another embodiment, leading edge 15 bows out in a curved fashion between fin base 13 and tip 17 (not shown). In such a configuration, leading edge 15 directs debris suspended in a water flow away from the water inlet 07. While a majority of the debris will be directed towards a tip 17, some debris can be pushed up toward base 13.

It is contemplated that fin 11 and mounting base plate 15 are constructed from metals, composite materials and/or a combination of both with sufficient characteristics to be wear resistant, withstand debris strikes and oscillations without significant fatigue. It has been determined that a fin 11 with a length between about 2 inches to about 24 inches from base 13 to tip 17 with a cross sectional thickness between about 0.001 inches to about 3 inches and a leading edge cant between about 1 degree and about 80 degrees off a longitudinal axis running the length of a fin 11 causes debris to be deflected from an adjacent water inlet 07; and further encourages water turbulence around an adjacent water intake and propeller. The cross sectional shape of fin 11 can be elliptical, oval, circular, arcuate, square, polygonal, rectangular and/or a combination thereof.

In one embodiment, fin 11 is constructed from stainless steel (or aluminum) plate with a thickness of about one sixteenth of an inch; a base 13 to tip 17 length of approximately nine to twelve inches and a leading edge cant of about 78 degrees off a longitudinal axis. Such a fin 11 is welded to mounting base plate 13. Once mounted in a vertical orientation to a cavitation plate 05, fin 11 directs water borne debris down along leading edge 15 and away from water inlet 07. Furthermore a rectangular cross section of fin 11 creates turbulence within the water that flows adjacent to a water inlet 07 and propeller 03. Such fin-induced turbulence prevents or at least reduces the likelihood of waterborne debris from clogging a water inlet 07. Another benefit of such fin-induced turbulence is the reduction of propeller 03 cavitation during take-offs.

In a preferred embodiment, fin 11 as described above is fitted with a set of limiting brackets 19 near tip 17. Limiting brackets 19 extend away from fin 11 and toward outboard motor lower unit 01 (See FIG. 2). If fin 11 begins to oscillate (side to side and/or twist) within a flow of water, limiting brackets 19 come in contact with outboard motor lower unit 01 to restrain the movement. Limiting brackets 19 prevent excessive fin oscillations. Excessive fin oscillations can cause the misdirection of water away from an inlet, the creation of cavitation bubbles (in extreme cases) or even fin failure. In another embodiment, limiting brackets 19 are mounted to outboard motor lower unit 01 (rather than fin 11) and extend toward fin 11 (Not shown). If fin 11 begins to oscillate (as described above), limiting brackets 19 come in contact with fin 11 to prevent further movement.

Figure 3:
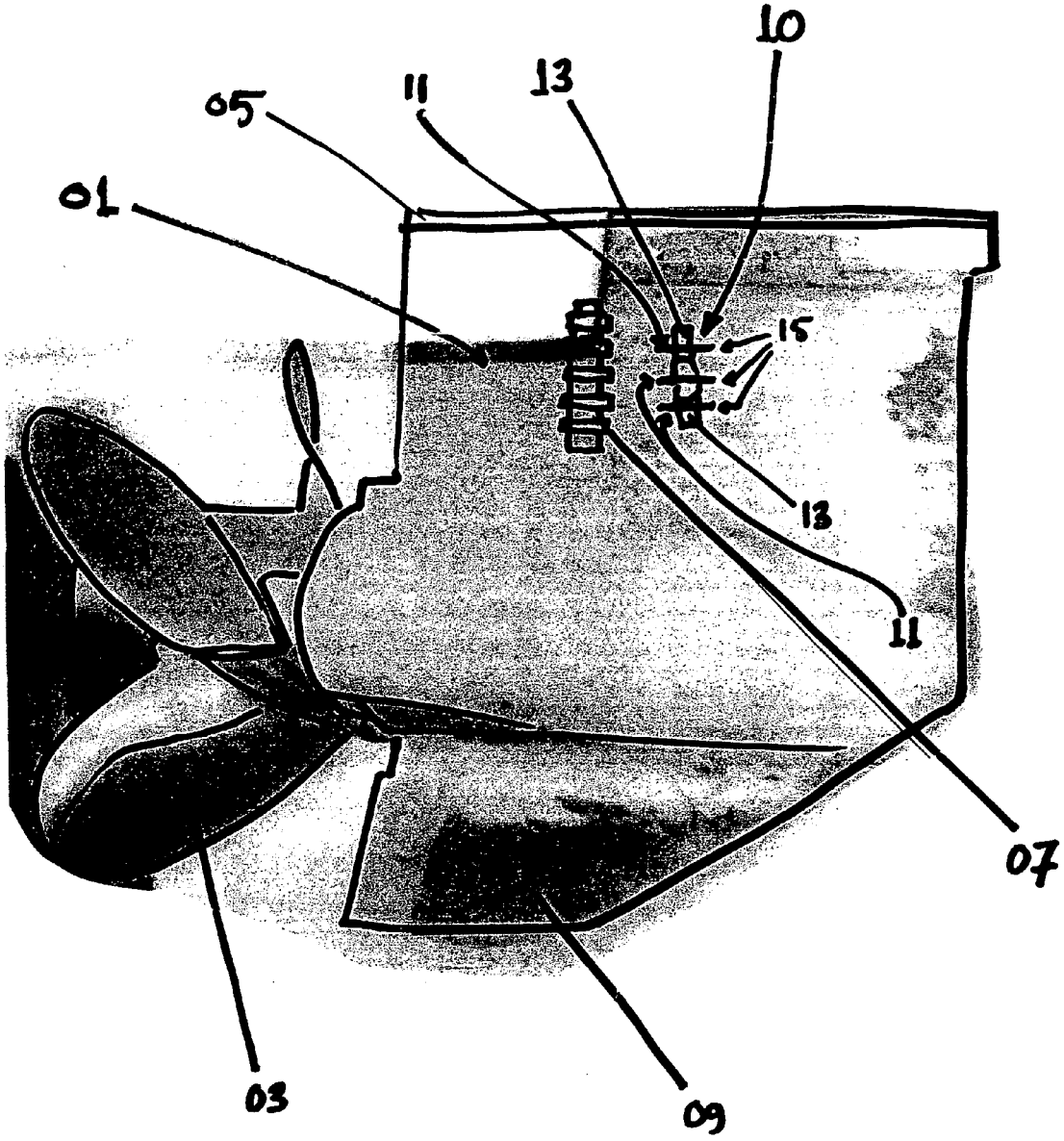
FIG. 3 is an elevation view of an improved weed deflector fixed horizontally to a stern drive of an inboard outboard engine.

In a preferred horizontal orientation of the deflector, a number of fins 11, are positioned horizontally across water inlet 07 (See FIG. 3). The length of a fin between base 13 and tip 17 is about 2 inches with a leading edge 15 cant of about 70 degrees and an arcuate cross sectional shape with a thickness of about ¼ of an inch to promote turbulence around water inlet 07. It is further contemplated that tip 17 is rounded.

A weed deflector 10 and its components have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

What is claimed and desired to be secured by Letters Patent is as follows:

1. A debris deflector for a water intake for a lower unit of an outboard motor comprising:

a fin with a leading edge disposed between a base and a tip, said base fixed to a mounting plate adapted to mount said fin to the lower unit and position a portion of said leading edge up flow of and generally at the same depth as the water intake; said leading edge sweep no less than about 1 degree and no greater than about 80 degrees from a longitudinal axis to re-direct the movement of debris suspended in a water flow toward said tip and away from the water intake; said fin having a length between said base and said tip of no less than about 2 inches and no greater than about 24 inches and a cross sectional thickness no less than about 0.001 inches and no greater than about 3 inches to promote turbulent water flow near the water intake.

2. A debris deflector as claimed in claim 1, wherein said fin is fixed in a vertical orientation with said tip below said base, said length is no less than about 9 inches and no greater than about 12 inches, said cross sectional thickness is about $1/16^{th}$ of an inch and said leading edge sweep is about 78 degrees.

3. A debris deflector as claimed in claim 1, wherein said cross sectional form and thickness is sufficient to cause turbulent water flow near a propeller attached to the lower unit, thereby reducing propeller cavitation.

4. A debris deflector as claimed in claim 1, wherein a pair of opposing limiting brackets are fixed to said fin near said tip and extend towards the lower unit, said limiting brackets configured to prevent over oscillation of said fin in a water flow.

5. A debris deflector as claimed in claim 1, wherein a pair of opposing limiting brackets are fixed to the lower unit and extend towards said fin near said tip, said limiting brackets configured to prevent over oscillation of said fin in a water flow.

6. A debris deflector for a water intake for a lower unit of an outboard motor comprising:

a fin with a leading edge disposed between a base and a tip, said base fixed to a mounting plate adapted to mount said fin to the lower unit and position a portion of said leading edge up flow of and generally at the same depth as the water intake; said leading edge sweep no less than about 1 degree and no greater than about 80 degrees from a longitudinal axis to re-direct the movement of debris suspended in a water flow toward said tip and away from the water intake; said fin having a length between said base and said tip of no less than about 2 inches and no greater than about 24 inches and a cross sectional thickness no less than about 0.001 inches and no greater than about 3 inches to promote turbulent water flow near the water intake; said cross sectional form and thickness sufficient to cause turbulent water flow near a propeller attached to the lower unit, thereby reducing propeller cavitation; and said fin has a triangular shape, and said tip is truncated.

7. A debris deflector as claimed in claim 6, wherein said fin has a vertical orientation, said length is no less than about 9 inches and no greater than about 12 inches, said cross sectional form is rectangular, said cross sectional thickness is about $1/16^{th}$ of an inch and said leading edge sweep is about 78 degrees.

8. A debris deflector as claimed in claim 7, wherein said fin is constructed from stainless steel plate.

9. A debris deflector as claimed in claim 6, wherein said fin has a horizontal orientation, said length is about 2 inches, said cross sectional form is arcuate, said cross thickness is about ¼ of an inch, and said leading edge sweep is about 70 degrees.

10. A debris deflector as claimed in claim 9, wherein said fin is constructed from aluminum materials.

11. A debris deflector for a water intake for a lower unit of an outboard motor comprising:

a fin with a leading edge disposed between a base and a tip, said base fixed to a mounting plate adapted to mount said fin to the lower unit and position a portion of said leading edge up flow of and at the same depth as the water intake; said leading edge bowed outwardly to re-direct movement of debris suspended in a water flow away from the water intake; said fin having a length between said base and said tip of no less than about 2 inches and no greater than about 24 inches and a cross sectional thickness no less than about 0.001 inches and no greater than about 3 inches to promote turbulent water flow near the water intake.

* * * * *